US008584300B2

(12) United States Patent
Weis

(10) Patent No.: US 8,584,300 B2
(45) Date of Patent: Nov. 19, 2013

(54) SQUEEZE MOP

(75) Inventor: Norbert Weis, Heddesheim (DE)

(73) Assignee: Carl Freudenberg KG, Weinheim (DE)

( * ) Notice: Subject to any disclaimer, the term of this patent is extended or adjusted under 35 U.S.C. 154(b) by 688 days.

(21) Appl. No.: 12/277,815

(22) Filed: Nov. 25, 2008

(65) Prior Publication Data

US 2009/0139041 A1 Jun. 4, 2009

Related U.S. Application Data

(60) Provisional application No. 60/991,063, filed on Nov. 29, 2007.

(51) Int. Cl.
*A47L 13/146* (2006.01)

(52) U.S. Cl.
USPC ..... 15/119.2; 15/228

(58) Field of Classification Search
USPC ..... 15/118, 119.2, 116.1, 116.2, 244.1
See application file for complete search history.

(56) References Cited

U.S. PATENT DOCUMENTS

| | | | | | |
|---|---|---|---|---|---|
| 2,864,107 | A | * | 12/1958 | Greenleaf | 15/119.2 |
| 2,892,201 | A | | 6/1959 | Peterson et al. | |
| 4,468,830 | A | * | 9/1984 | Batchelor | 15/119.2 |
| 5,138,736 | A | * | 8/1992 | Pesa | 15/119.2 |
| 5,483,720 | A | * | 1/1996 | Decoopman et al. | 15/119.2 |
| 5,488,750 | A | * | 2/1996 | Vosbikian et al. | 15/119.2 |
| 6,000,087 | A | * | 12/1999 | Petner | 15/119.2 |
| 6,058,548 | A | * | 5/2000 | Footer et al. | 15/119.2 |
| 6,119,297 | A | * | 9/2000 | Ohm et al. | 15/119.2 |
| 6,389,635 | B1 | * | 5/2002 | Petner et al. | 15/119.2 |
| 6,675,426 | B2 | * | 1/2004 | Ohm et al. | 15/119.2 |
| 6,785,928 | B2 | * | 9/2004 | Specht et al. | 15/119.2 |
| 6,865,768 | B2 | * | 3/2005 | Chen | 15/115 |
| 6,976,282 | B2 | | 12/2005 | Sie | |
| D530,049 | S | * | 10/2006 | Berti | D32/44 |

(Continued)

FOREIGN PATENT DOCUMENTS

| | | |
|---|---|---|
| DE | 216565 | 11/1909 |
| DE | 1954499 | 2/1967 |

(Continued)

*Primary Examiner* — Lee D Wilson
*Assistant Examiner* — Joel Crandall
(74) *Attorney, Agent, or Firm* — Grossman, Tucker, Perreault & Pfleger, PLLC

(57) ABSTRACT

Squeeze mop, including a bearing body that is formed by a double joint and two squeeze plates that are arranged on either side of the double joint in the longitudinal direction of the bearing body and that are joined thereto, and a handle, the bearing body having on the side that faces axially away from the handle a mopping pad that is largely the size of the bearing body and the squeeze plates being pressable against one another by means of a wringing device, the wringing device being fork-shaped and embodied open on the side facing axially away from the handle and including two pressure arms that are arranged largely parallel to one another and that for folding the squeeze plates can be caused to engage with the squeeze plates about the double joint, the wringing device being joined to the handle and the handle being pivotably joined to the double joint, at least about the longitudinal axis of the bearing body, the wringing device having an actuating rod that is axially movable toward the handle and that is joined at one end face to the double joint and at the other end face to a pivotable grip that is attached location-fast to the handle for actuating the wringing device.

7 Claims, 13 Drawing Sheets

(56) References Cited

U.S. PATENT DOCUMENTS

| | | | | |
|---|---|---|---|---|
| 7,225,497 | B1 * | 6/2007 | Ho | 15/119.2 |
| 7,257,853 | B2 * | 8/2007 | Boyer et al. | 15/119.2 |
| 7,260,864 | B1 * | 8/2007 | Morad | 15/116.2 |
| 7,469,441 | B2 * | 12/2008 | Hirse | 15/119.2 |
| 2002/0029433 | A1 * | 3/2002 | Libman | 15/119.2 |
| 2002/0056167 | A1 | 5/2002 | Ohm et al. | |
| 2004/0158947 | A1 | 8/2004 | Sie | |
| 2004/0187240 | A1 * | 9/2004 | Berti et al. | 15/116.2 |
| 2005/0028309 | A1 | 2/2005 | Boyer et al. | |

FOREIGN PATENT DOCUMENTS

| | | |
|---|---|---|
| DE | 1293983 | 4/1969 |
| DE | 29713657 | 11/1997 |
| DE | 20310699 | 10/2003 |
| EP | 1208788 | 5/2002 |
| EP | 1472965 | 11/2004 |
| GB | 985124 | 3/1965 |
| GB | 1342068 | 12/1973 |
| WO | 2004054424 | 7/2004 |

* cited by examiner

SQUEEZE MOP

CROSS REFERENCE TO RELATED APPLICATIONS

The present application claims the benefit of the filing date of U.S. Provisional Application Ser. No. 60/991,063, filed Nov. 29, 2007, the teachings of which are incorporated herein by reference.

TECHNICAL FIELD

The invention relates to a squeeze mop, including a bearing body that is formed by a double joint and two squeeze plates that are arranged on either side of the double joint in the longitudinal direction of the bearing body and that are joined thereto, and a handle, the bearing body having on the side that faces axially away from the handle a mopping pad that is largely the size of the bearing body and the squeeze plates being pressable against one another by means of a wringing device, the wringing device being fork-shaped and embodied open on the side facing axially away from the handle and including two pressure arms that are arranged largely parallel to one another and that for folding the squeeze plates can be caused to engage with the squeeze plates about the double joint, the wringing device being joined to the handle and the handle being pivotably joined to the double joint, at least about the longitudinal axis of the bearing body.

PRIOR ART

Such a squeeze mop is known from EP 1 208 788 B1. The known squeeze mop is provided for cleaning planar surfaces, the handle being pivotably attached to the double joint. On the handle a sliding sleeve is movably axially borne toward the handle, the known squeeze mop having guide devices on the squeeze plates and/or in the pressure arms for folding the squeeze plates in a defined manner by means of the pressure arms. Using the cardanic movability of the double joint relative to the handle it is also possible to clean well in the main mopping direction, even under low furniture.

The sliding sleeve constitutes a gripping part, a sliding region having a guide slot, and the fork-shaped molded pressure arms. However, when actuating the sliding sleeve it should be noted that overall large forces must be applied in order to press the squeeze plates against one another and thereby to wring out the mopping pad. The stiffer the material that comprises the mopping pad, the higher the forces to be applied. It is significantly more difficult to use the aforesaid squeeze mop, and no longer satisfactory, in particular when the gripping part of the sliding sleeve is wet and therefore dripping.

Known from DE-AS 1 293 983 is a cleaning device having a cleaning tool, such as for instance a sponge, that is attached to a holder, and a device for wringing out the cleaning tool. The device comprises a fork-shaped roller holder that is joined to a device handle and that has two parallel rows of rollers, and furthermore comprises an actuating rod that is displaceable toward the device handle by means of a grip on the device handle and that receives the roller holder on its lower end. The actuating rod pulls the cleaning tool between the rollers during wringing. The cleaning tool is in particular formed by a sponge that has a curved surface of more than 180°. The device handle and the cleaning tool are joined to one another rigidly, that is, they are not angularly displaceable; the device handle is not angularly displaceable relative to the cleaning tool. Such a rigid configuration is not very satisfactory, in particular for a cleaning tool that has a flat mopping surface, for instance a mopping pad that is used in squeeze mops, rather than a curved mopping surface, because optimum cleaning of the planar surface to be cleaned is not possible unless the flat mopping pad is positioned flat on the surface. When using a cleaning device the user is hardly in a position to ensure this optimum configuration when the relationship of handle to cleaning tool is rigid. In such cleaning devices, even minor changes in the angular position of the handle relative to the surface to be cleaned cause disadvantageous usage properties and have a negative impact on cleaning results.

DEPICTION OF THE INVENTION

The underlying object of the invention is to further develop a squeeze mop of the aforesaid type such that the wringing device is simpler to operate, that is, can be operated with less exertion of force, and such that therefore the risk of injury to the user is reduced, even when the user has wet hands and/or the squeeze mop is wet and dripping.

For attaining the object it is provided that the wringing device has an actuating rod that is axially movable toward the handle and that is joined at one end face to the double joint and at the other end face to a pivotable grip that is attached location-fast to the handle for actuating the wringing device. It is advantageous that the wringing device can be actuated particularly easily and safely. For pressing the squeeze plates against one another, which squeeze plates can be covered with a common mopping pad or can each be provided with a mopping pad, the user holds the handle in one hand and the other hand of the user grasps the grip. The grip can be embodied either as a knob or preferably in a ring shape. Then the grip is pivoted toward the upper end of the handle, it being advantageous that the grip is attached relatively fixed on the handle. This simplifies handling because undesired relative movements in the axial direction between the grip and the handle are avoided. Even when the grip and/or the hand of the user is/are wet and dripping the squeeze mop can be wrung out safely without the risk that the user's hand will slip from the grip, possibly causing injury to the user.

The combination of a handle that is pivotably joined to the double joint at least about the longitudinal axis of the bearing body in order to be able for instance to also clean with no problem flat surfaces and under low furniture in a FIG. 8 and a pivotable grip attached location-fast to the handle for actuating the wringing device are not found in the known prior art; the squeeze mop is simple and safe to use and it cleans well, even in areas that are difficult to access.

It is preferably provided that the actuating rod runs largely in the handle. This protects the actuating rod from external influences so that undesired deformations of the actuating rod are prevented and thus any resulting negative impact on usage properties of the wringing device is prevented. In addition, the handle therefore does not have an unnecessary number of parts that project therefrom that can catch on and possibly injure the user.

Further improved usage properties in terms of squeeze mop cleaning performance can be attained in that the handle is joined to the double joint in a cardanically movable manner. This further simplifies handling of the squeeze mop for cleaning e.g. areas under furniture that are difficult to access.

The squeeze plates can each be joined to the double joint by means of a spring and can be pressable against one another against the spring force of the springs when the wringing device is actuated.

The springs can be embodied as hairpin springs and attached to the double joint such that after the wringing process the springs cause not only a plane-parallel orientation of the squeeze plates that were pressed against one another relative to the surface to be cleaned. Such a spring force-supported automatic plane-parallel orientation of the squeeze plates relative to the surface to be cleaned is particularly advantageous when a mopping pad is used that has only a small restoring force toward flatness after the wringing process. Without the assistance of the spring force the squeeze plates would still form an angle to one another after the wringing process and would not be positioned plane-parallel to the surface to be cleaned until the user placed the squeeze mop onto the surface to be cleaned.

After the wringing process, the springs can also cause the squeeze plates to be oriented with respect to the handle such that it is possible to immediately continue to mop the surface to be cleaned. For instance, due to the spring force, the squeeze plates can automatically be oriented tilted at a 20 to 30° angle relative to the vertical arrangement of the handle. The squeeze mop the springs act advantageously upon the usage properties while the mop is being used, as well. The springs damp the movement of the handle, in particular about the longitudinal axis of the bearing body. Mopping pads that have a high cross-section, which are therefore more unstable during use than mopping pads that have a low cross-section and that tend to tilt, would be difficult to control without damping the movement of the bearing body relative to the handle. The cleaning results would be negatively affected by this.

The wringing device can be provided with a coupling for receiving an exchangeable scouring body. The coupling and the scouring body fixed thereto can be positioned at an angle of essentially 90° to the mopping pad. The scouring body can comprise different materials. Thus, for instance, it is possible for the scouring body to comprise a sponge that is more abrasive than the mopping pad. In accordance with another embodiment, the scouring body can include bristles that comprise a polymer or elastomer material, wherein a combination of the aforesaid embodiments/materials can make sense, depending on the application. The combination of mopping pad and scouring body is particularly advantageous when the surfaces to be cleaned are heavily soiled and would be difficult to clean with just the mopping pad. In such a case the user would first use the scouring body to loosen the heavy soilage from the surface to be cleaned in order to then pick up and remove the loosened soilage using the mopping pad. These processes could be accomplished with one and the same squeeze mop.

On their sides axially facing one another the pressure arms can have guide grooves running axially toward the handle that can each be caused to engage with a guide cam of the respective squeeze plate during wringing. Due to the embodiment and arrangement of the guide grooves and guide cams, it is possible to wring out the mopping pad without the parts that run into one another tilting and jamming. In addition, the squeeze plates and the double joint orient themselves largely perpendicular to the handle, regardless of what angle they previously formed relative to the handle, before the squeeze plates are pulled between the pressure arms of the wringing device by actuating the grip by means of the actuating rod; manual orientation prior to the wringing process is therefore not necessary.

If the two squeeze plates attached to the double joint are long, it is advantageous to ensure reinforced pressure on the pressure arms in the area of the ends of the squeeze plates that face away from the double joint in order to obtain a mopping pad that has been wrung out well even in the area of the ends. For this it can be provided that each squeeze plate has on its side facing away from the mopping pad a ramp that rises in height outward from the double joint in the longitudinal direction of the bearing body for gradually increasing the pressing force during the wringing process. With such a ramp, the user can decide individually whether the mopping pad should be wrung out more or less. When needed the mopping pad is also wrung out well on the side facing away from the double joint.

BRIEF DESCRIPTION OF DRAWINGS

One exemplary embodiment of the inventive squeeze mop is explained in greater detail in the following using FIGS. 1 through 13.

EMBODIMENT OF THE INVENTION

Figure 1:
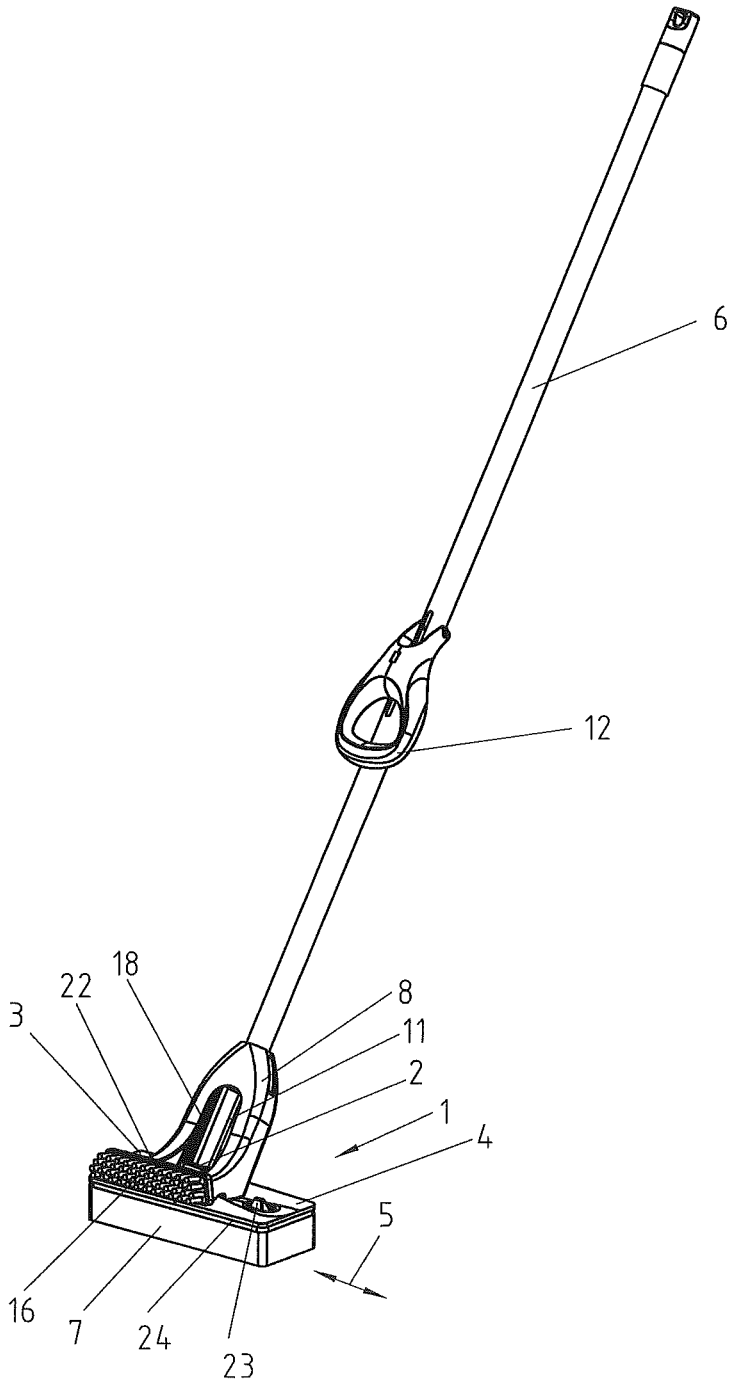
FIG. 1 is a perspective elevation of the inventive squeeze mop.

One exemplary embodiment of the inventive squeeze mop is depicted in FIG. 1 and in FIGS. 2 through 13. The squeeze mop includes a bearing body 1 that is made of a polymer material and that comprises a centrally arranged double joint 2, one squeeze plate 3, 4 being attached in the longitudinal direction 5 of the bearing body 1 on each side of the double joint 2. The double joint 2 and the two squeeze plates 3, 4 are joined to one another such that when the wringing device 8 is actuated both of the squeeze plates 3, 4 can fold downward relative to the double joint 2. On its side facing axially away from the handle 6 the bearing body 1 has a single-part mopping pad 7 that is the same size as the bearing body 1 and that is embodied as a sponge. Instead of the single-part mopping pad 7 depicted here, it is possible to use a multi-part mopping pad, for instance a two-part mopping pad, each part then being the size of one squeeze plate 3, 4. One pressure arm 9, 10 of the wringing device 8, which is fork-shaped and is open on the side facing away from the handle, acts on each squeeze plate 3, 4. The wringing device 8 is joined location-fast to the handle 6, the handle 6 being joined, pivotable about the longitudinal axis 5 of the bearing body 1, to the double joint 2.

The connection between the handle on which the wringing device 8 is arranged and the bearing body 1 is attained using an actuating rod 11 that can be moved axially toward the handle 6. The actuating rod 11 is joined at one end face to the double joint 2 and at the other end face to the grip 12 that is attached to the handle 6 location-fast but pivotable. The wringing device 8 is actuated using the grip 12. Using such a design the wringing device 8 can be handled simply and with no problem, even if the user's hands and/or the grip 12 are wet and/or dripping.

As can be seen from FIGS. 1, 2, 4 through 6, and 9 through 13, with the exception of its end face ends in the area of the double joint 2 and the grip 12, the actuating rod 11 runs in the interior of the handle 6 so that the actuating rod is protected from undesired external influences and damage that might result therefrom. On their p. 1 facing away from the mopping pad 7 the squeeze plates 3, 4 can have a ramp 22, 23 that rises in height outward from the double joint 2 in the longitudinal direction 5 of the bearing body 1 for gradually increasing the pressing force during the wringing process.

Figure 2:
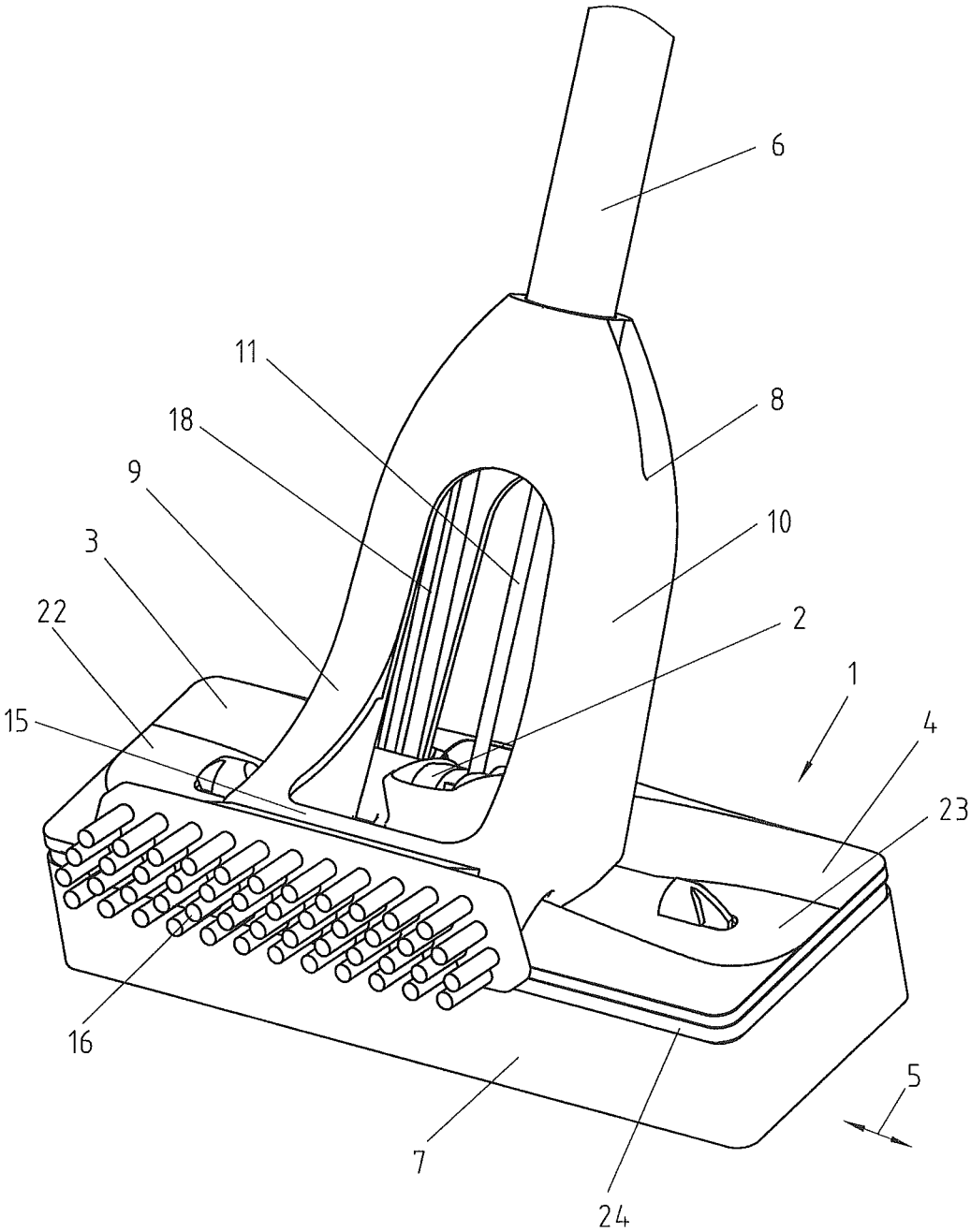
FIG. 2 is an enlarged depiction of the mop head from FIG. 1.

FIG. 2 is an enlarged depiction of the mopping pad from FIG. 1. Provided on the wringing device 8, which comprises a polymer material, is a coupling 15 for receiving an exchangeable scouring body 16, the coupling 15 and the scouring body 16 being joined to one another in a press-fit and/or force fit. Preferably a force-fit join is used, for instance in the form of a dovetail. In this manner a used scouring body 16 can be removed from the coupling 15 as needed with the application of a small amount of force and can be replaced with a new scouring body 16. The scouring body 16 is arranged at a 90° angle 17 to the mopping pad 7. The combination of mopping pad 7 and scouring body 16 combined in a squeeze mop is particularly advantageous when the scouring body 16 is first used to loosen heavy soilage from the surface to be cleaned and this loosened soilage is then picked up by the mopping pad 7 and then removed. The scouring body 16 includes a plurality of bristles in the example depicted here.

Figure 3:
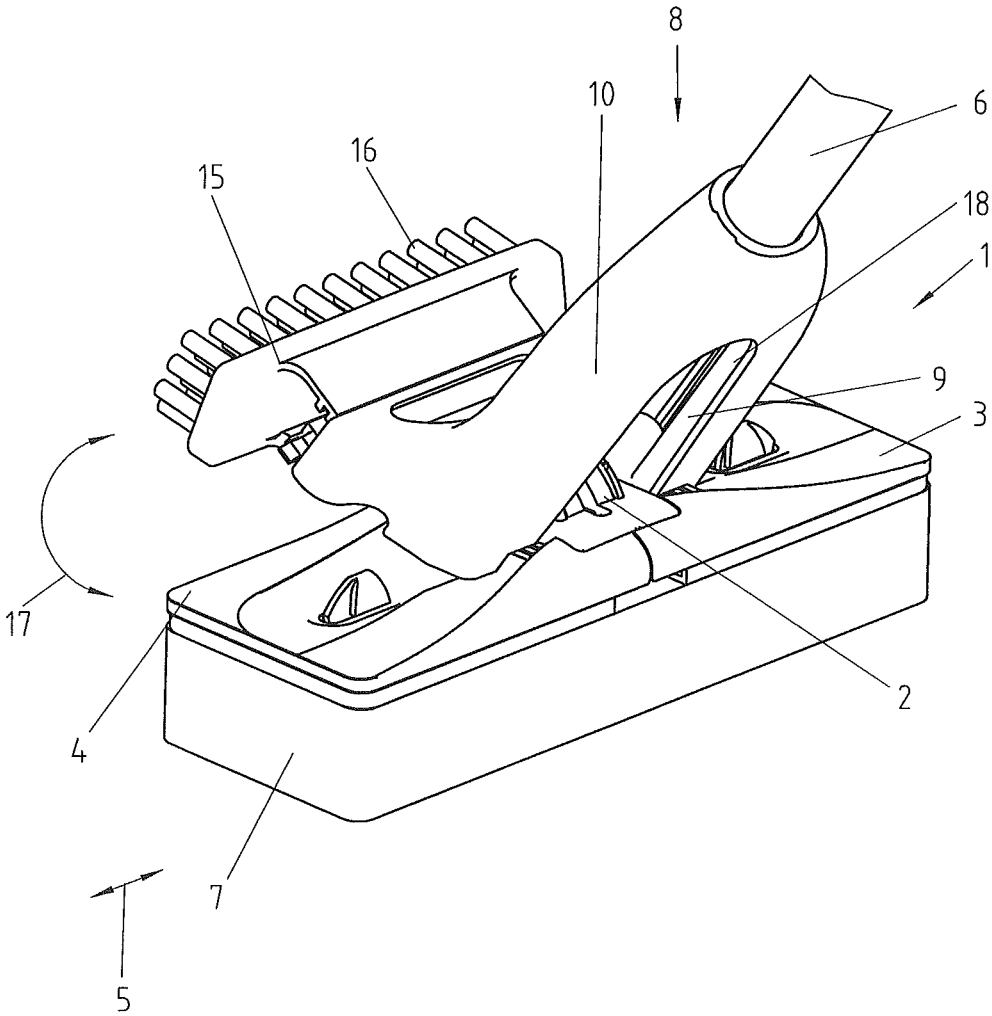
FIG. 3 depicts the mop head from FIG. 2 from behind.

FIG. 3 depicts the mop head in FIG. 2 from behind. In the exemplary embodiment depicted, the mopping pad 7 is attached to the bearing body 1 using a hook-and-loop closure 24 that joins the mopping pad 7 to the two squeeze plates 3, 4. In comparison to the depiction in FIG. 2, the handle 6 in FIG. 3 is inclined to the rear about the longitudinal axis 5 of the bearing body 1.

Figure 4:
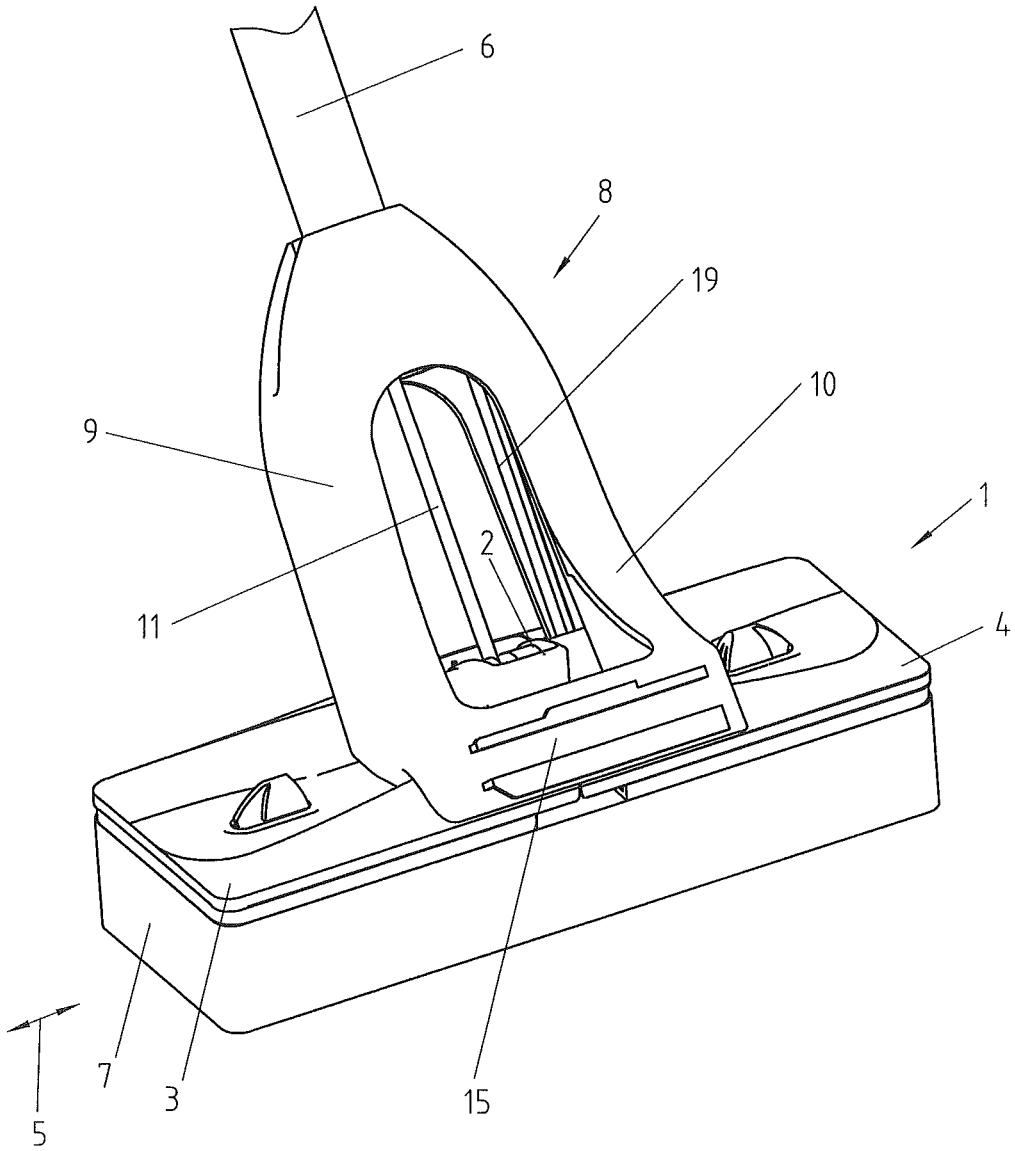
FIG. 4 depicts the mop head from FIG. 2 with the scouring body removed.

The mop head from FIG. 2 is depicted in FIG. 4 with the scouring body 16 removed. The coupling 15 has a dovetail shape.

Figure 5:
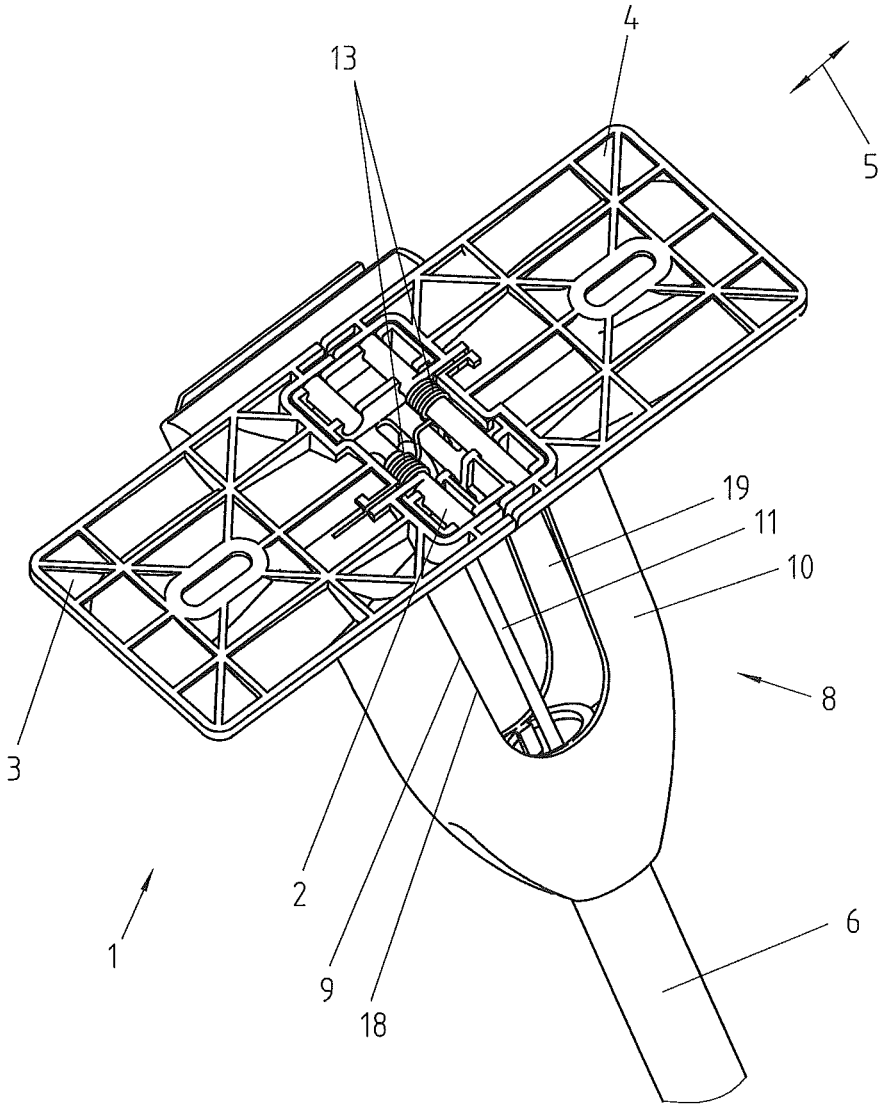
FIG. 5 depicts the bearing body, without mopping pad, from below.
Figure 6:
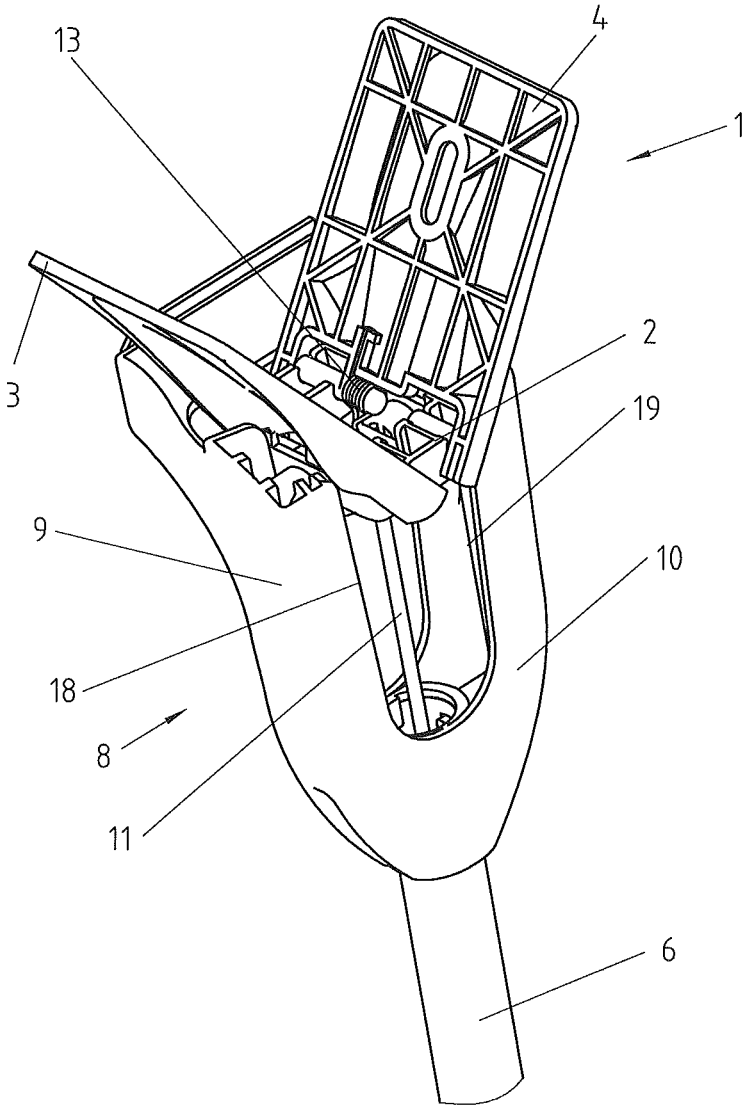
FIG. 6 depicts the bearing body from FIG. 5, with actuated wringing device during initiation of the wringing process.

FIGS. 5 and 6 each depict views of the bearing body 1 from below without the mopping pad 7. It can be seen that the two squeeze plates 3, 4 are each joined to the double joint 2 by means of a spring 13, 14 and can be pressed against one another against the spring force of the springs 13, 14 when the wringing device 8 is actuated. The springs 13, 14 are embodied as hairpin springs and, due to their arrangement, also cause the movement of the handle 6 about the longitudinal axis 5 of the bearing body 1 to be "damped". This clearly reduces undesired and difficult to control tilting movements of the bearing body 1 relative to the handle 6 so that handling of the squeeze mop is significantly improved overall, in particular when the mopping pad 7 has a high cross-section and is therefore very flexible overall.

Figure 7:
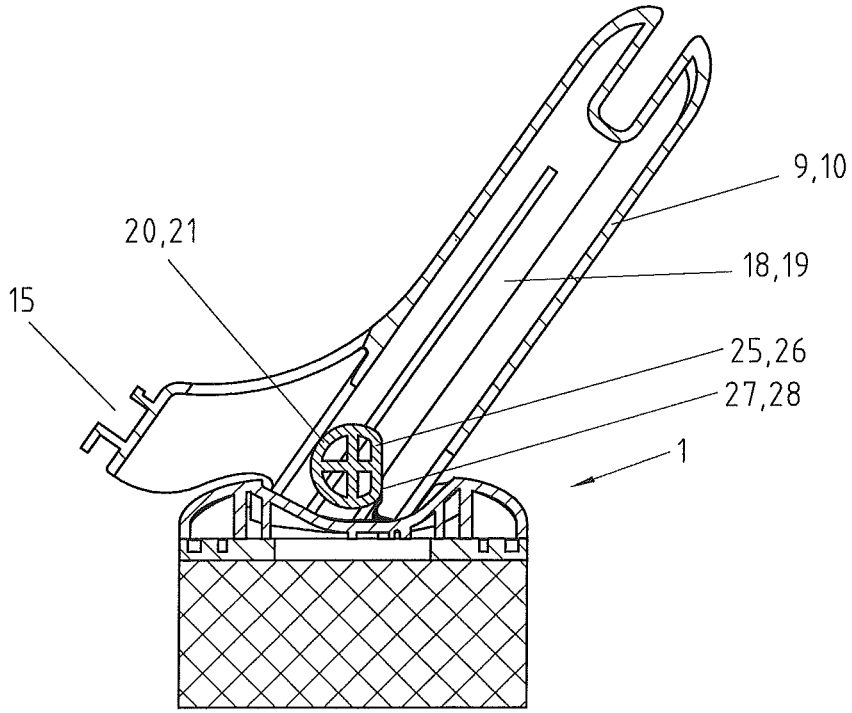
FIG. 7 is a section through the wringing device during proper use of the squeeze mop.
Figure 8:
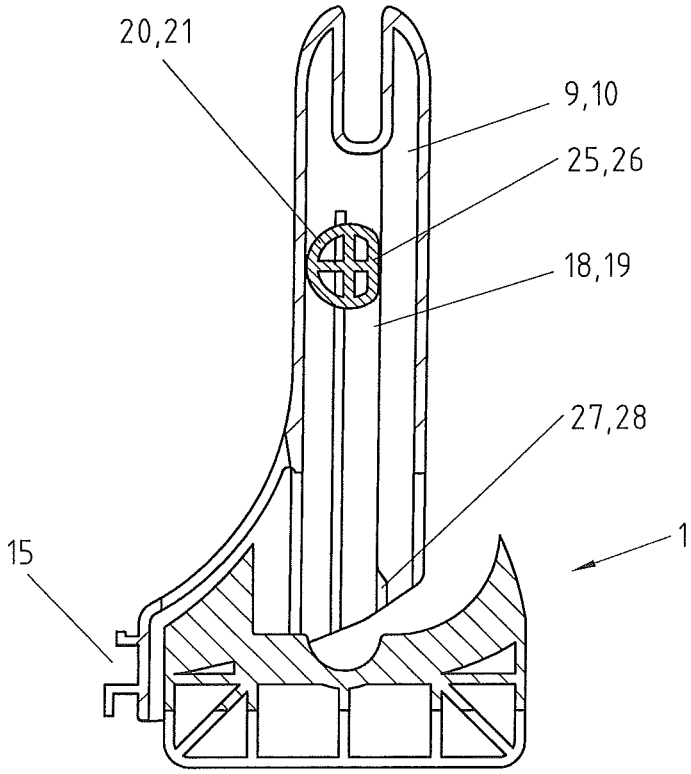
FIG. 8 is a section corresponding to FIG. 7 with a guide cam of a squeeze plate, which guide cam is moved upward in the guide groove of the pressure arm during the wringing process.

FIGS. 7 and 8 depict sections of the operational status in accordance with FIGS. 5 and 6. In FIG. 7 the guide cams 20, 21 of the squeeze plates 3, 4 are positioned in the guide grooves 18, 19 in the lower area. The pressure arms 9, 10 of the wringing device 8 are inclined to the vertical and are in the position that the squeeze mop normally assumes when cleaning planar surfaces. Because of the flattened areas 25, 26 of the guide cams 20, 21 and the flattened insertion inclines 27, 28 of the guide grooves 18, 19, there can be no undesired displacement. In FIG. 8 the wringing device 8 is moved, together with its pressure arms 9, 10, into the vertical, relative to the bearing body 1, for wringing out the mopping pad 7. The guide cams 20, 21 move into the guide grooves 18, 19 during the wringing process.

Figure 9:
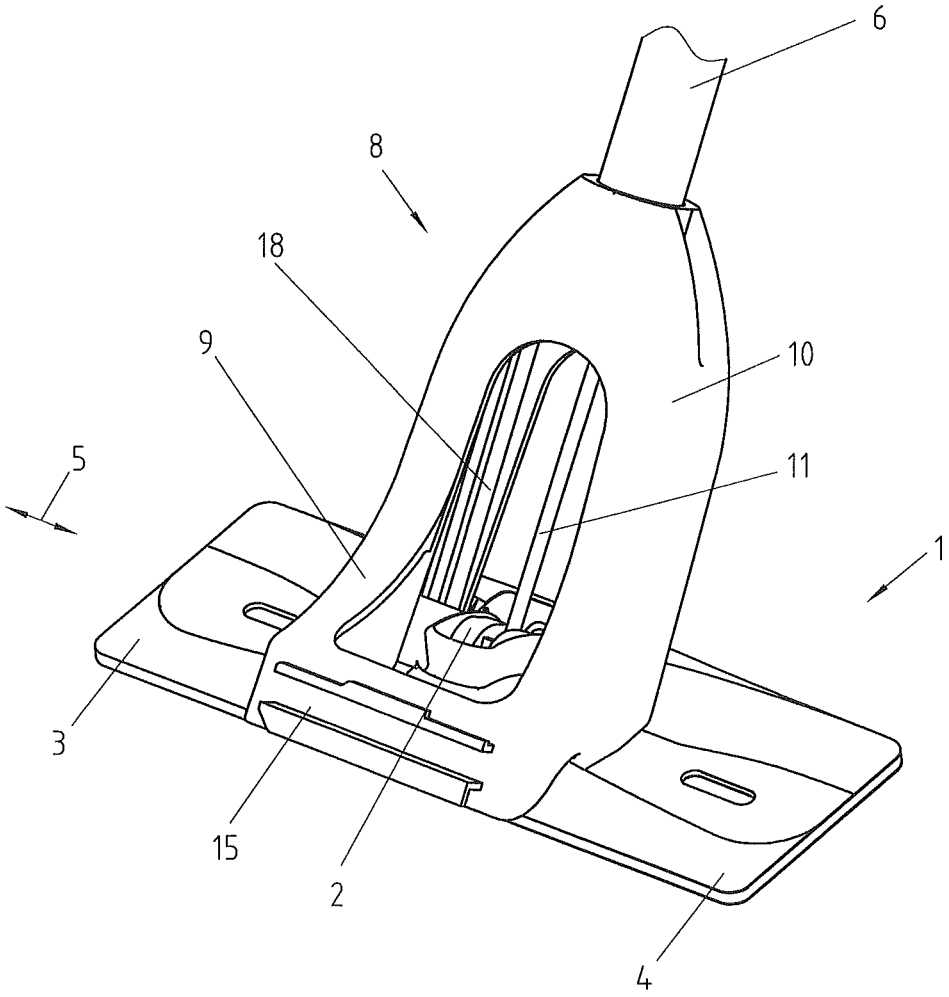
FIGS. 9 through 13 depict the wringing process in chronological sequence.

FIGS. 9 through 13 depict the wringing process in a chronological sequence, the mopping pad 7 and the scrubbing body 16 not being depicted in order to facilitate understanding. FIG. 9 depicts the inventive squeeze mop during proper use when cleaning flat surfaces. The squeeze plates 3, 4 and the double joint 2 are in one plane.

Figure 10:
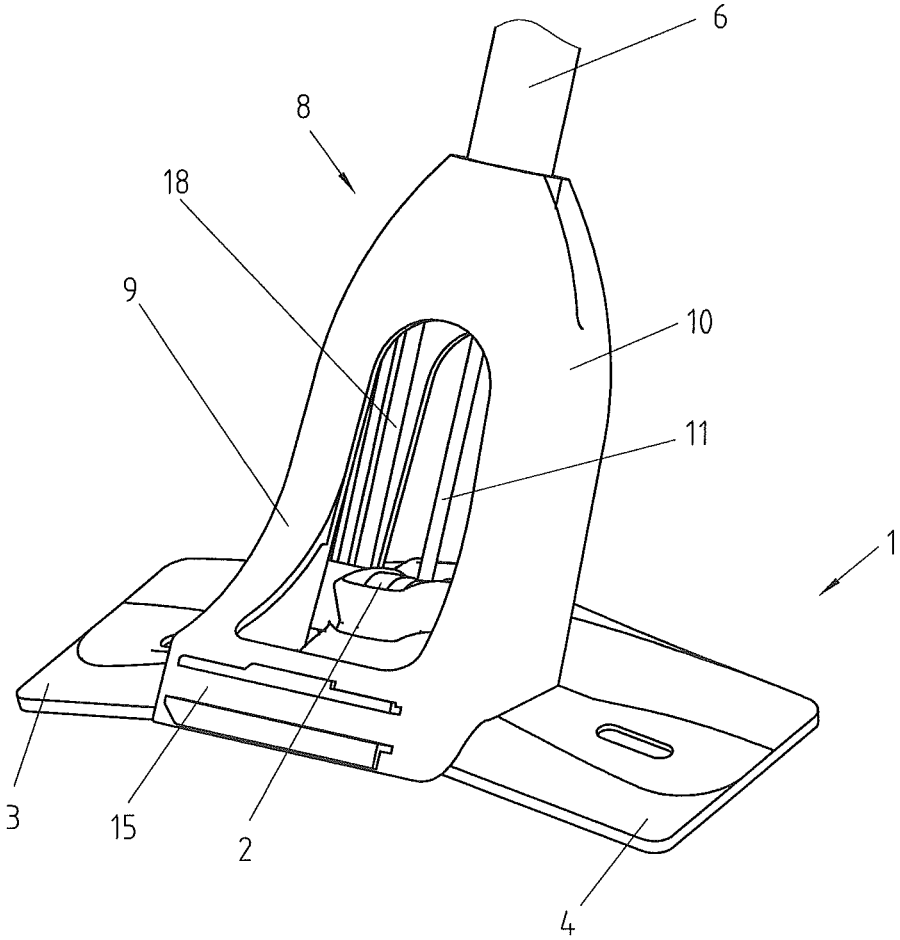

In FIG. 10 the grip 12 (see FIG. 1) is pivoted upward about a joint that is joined location-fast to the handle 6. While the grip 12 is pivoted upward, the actuating rod 11 that is joined axially on the one hand to the grip 12 and axially on the other hand to the double joint 2 also moves upward, thereby moving the double joint 2 with it, the squeeze plates 3, 4 being bent downward relative thereto and the guide cams 20, 21 of the squeeze plates 3, 4 moving into the guide grooves 18, 19 of the pressure arms 9, 10 of the wringing device 8.

Figure 11:
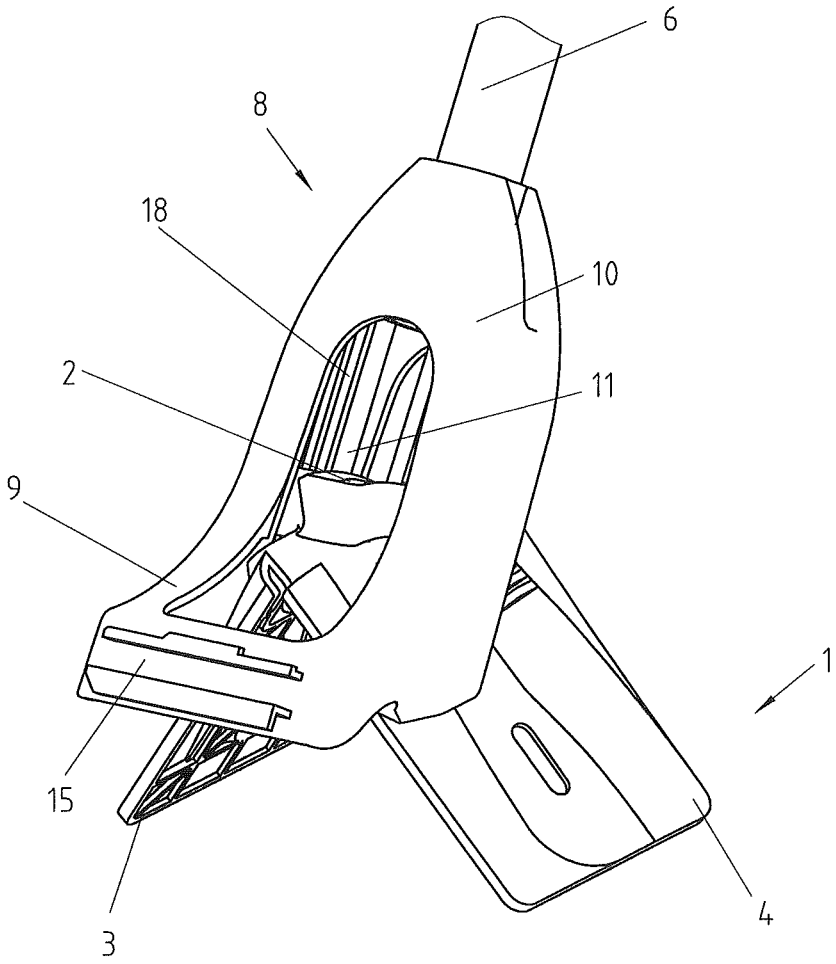
Figure 12:
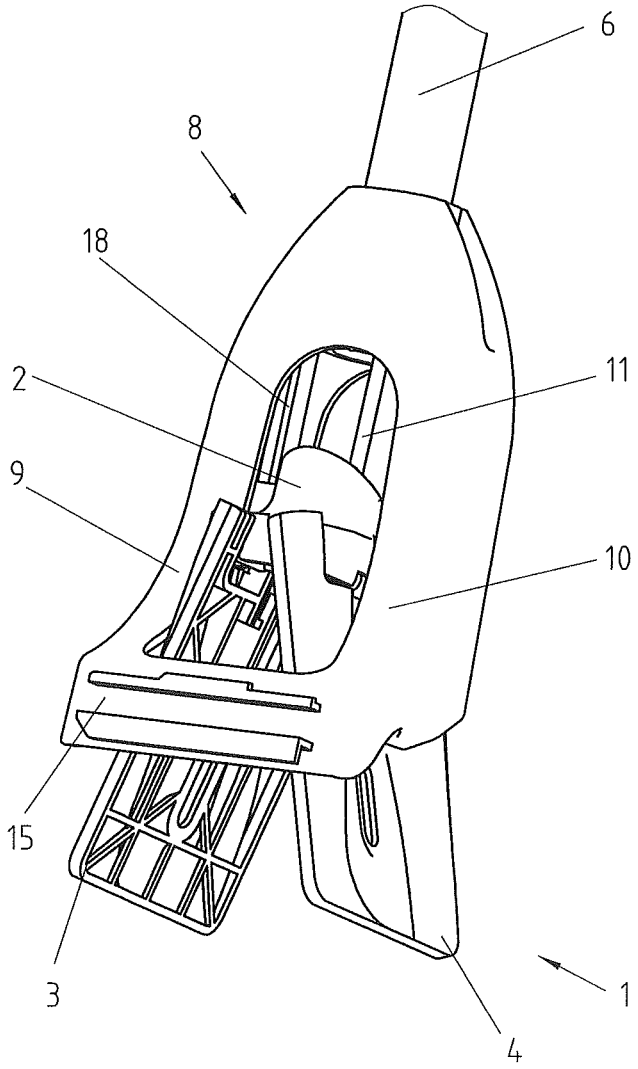
Figure 13:
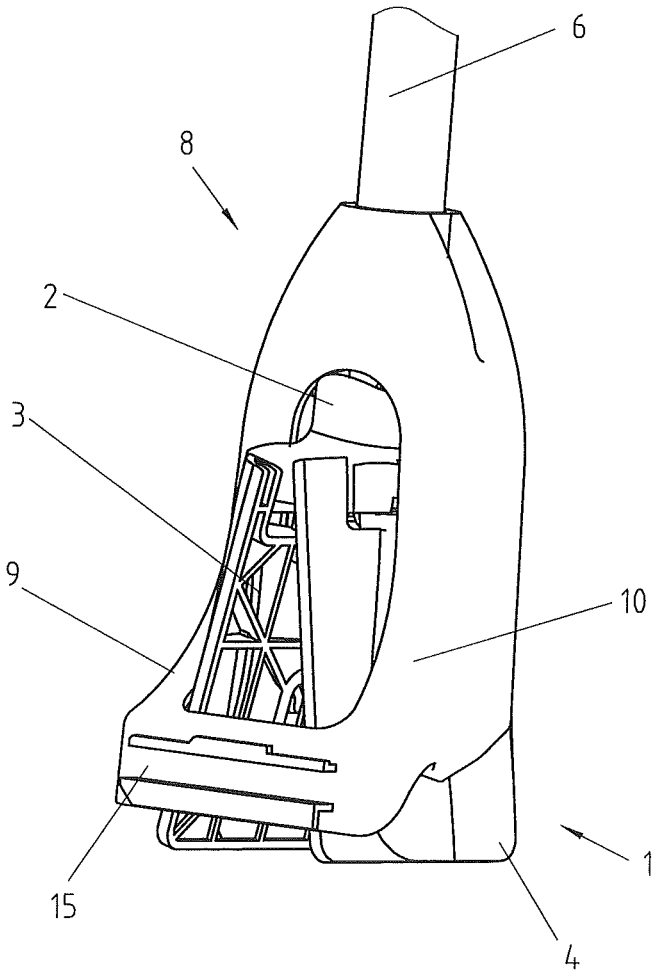

In FIGS. 11 through 13 the grip 12 is pulled further and further upward until the squeeze plates 3, 4 reach the position depicted in FIG. 13 relative to the wringing device 8. If the squeeze plates 3, 4 were provided with a mopping pad 7, it would now be wrung out.

Then the lever 12 depicted in FIG. 1 is returned to the position depicted in FIG. 1, the squeeze plates 3, 4 and the double joint 2 returning from the position in accordance with FIG. 13 to the positions depicted in accordance with FIGS. 12 through 10 and finally to the position depicted in FIG. 9.

What is claimed is:

1. A squeeze mop, comprising:

a bearing body comprising a double joint and two squeeze plates arranged on either side of said double joint in a longitudinal direction of said bearing body and that are joined thereto; and a handle;

wherein:

said bearing body comprises on a side that faces axially away from said handle a mopping pad that is largely the size of said bearing body;

said squeeze plates are pressable against one another by means of a wringing device, said wringing device being fork-shaped and embodied open on said side that faces axially away from said handle, said wringing device comprising two pressure arms that are arranged largely parallel to one another, said pressure arms being configured to fold said squeeze plates and engage with said squeeze plates about said double joint;

each of said pressure arms comprise a guide groove running axially toward said handle, wherein said guide grooves face each other and are each engageable with a respective moveable guide cam of a respective squeeze plate when the mopping pad is being wrung out, each guide cam being axially movable towards said handle within a respective guide groove;

said wringing device is joined to the handle, said handle being pivotably joined to said double joint at least about said longitudinal axis of said bearing body;

said wringing device further comprises an actuating rod comprising first and second end faces, said actuating rod being axially movable toward said handle and joined at said first end face to said double joint and at said second end face to a pivotable grip that is attached location-fast to said handle for actuating said wringing device;

said movable guide cams include respective flattened areas, wherein before said squeeze plates are pulled between the pressure arms of the wringing device said flattened areas orient said squeeze plates and double joint perpendicular to the handle; and said guide grooves each include a flattened insertion incline, wherein when said handle is inclined to a vertical axis orthogonal to the squeeze plates when said squeeze plates are unfolded, each of said movable guide cams pivot relative to said guide grooves about an axis defined by said longitudinal direction of said bearing body to engage said flattened areas of said movable guide cams with said flattened insertion inclines of said guide grooves.

2. Squeeze mop in accordance with claim 1, wherein said actuating rod runs largely in said handle.

3. Squeeze mop in accordance with claim 1, wherein said squeeze plates are each joined to said double joint by means of a spring and can be pressable against one another against the spring force of said springs when said wringing device is actuated.

4. Squeeze mop in accordance with claim 3, wherein said springs are embodied as hairpin springs.

5. Squeeze mop in accordance with claim 1, wherein said wringing device is provided with a coupling for receiving an exchangeable scouring body.

6. Squeeze mop in accordance with claim 5, wherein said coupling and said scouring body fixable thereto can be positioned at an angle of essentially 90° to said mopping pad.

7. Squeeze mop in accordance with claim 1, wherein each said squeeze plate has on its side facing away from said mopping pad a ramp that rises in height outward from said double joint in said longitudinal direction of said bearing body for gradually increasing the pressing force during the wringing process.

* * * * *